United States Patent [19]

Straus

[11] Patent Number: 4,677,728

[45] Date of Patent: Jul. 7, 1987

[54] ROLL EDGE PROTECTOR

[76] Inventor: Albert E. Straus, 1673 W. Eighth St., Erie, Pa. 16505

[21] Appl. No.: 822,598

[22] Filed: Jan. 27, 1986

[51] Int. Cl.[4] ..... B23P 17/00; A45C 11/34

[52] U.S. Cl. ..... 29/415; 206/414

[58] Field of Search ..... 264/177 R; 206/413, 206/414; 29/415

[56] References Cited

U.S. PATENT DOCUMENTS

| | | | |
|---|---|---|---|
| 291,406 | 1/1884 | Sanger | 206/414 |
| 1,772,850 | 8/1930 | Wheldon | 206/414 |
| 1,989,182 | 1/1935 | Blake | 206/414 |
| 1,989,183 | 1/1935 | Blake | 206/414 |
| 2,736,670 | 2/1956 | Griffiths | 264/177 R |
| 2,900,668 | 8/1959 | Hubner et al. | 264/177 R |
| 3,123,909 | 3/1964 | Dorst | 29/415 |
| 3,962,900 | 6/1976 | Leiblich | 29/415 |
| 4,505,387 | 3/1985 | Seto | 206/414 |
| 4,554,123 | 11/1985 | Smyth | 264/177 R |

*Primary Examiner*—Howard N. Goldberg
*Assistant Examiner*—Steven Nichols
*Attorney, Agent, or Firm*—Charles L. Lovercheck; Wayne L. Lovercheck; Dale R. Lovercheck

[57] ABSTRACT

Disclosed herein is a roll edge protector for packages of laminar material. The roll edge protector is preferably made of plastic, extruded in the shape of a channel and each section of the channel is cut to form two angular sections of edge protectors, each having scallops that are preferably identical to the other. The angular sections can be formed in indefinite lengths and stored or shipped in coils to be uncoiled and applied to the rolls of sheet material.

5 Claims, 5 Drawing Figures

ROLL EDGE PROTECTOR

REFERENCE TO PRIOR ART

Attempts have been made to provide end protector guards for rolls of sheet material, such as rolls of paper, such as shown in the following U.S. Patents: Sanger, U.S. Pat. No. 291,406, Dunnell, U.S. Pat. No. 298,562 and Duval, U.S. Pat. No. 542,728. These guards were commonly made of cardboard, metal or other flexible material but they were easily damaged, difficult to handle, some were expensive to manufacture and were not entirely satisfactory in use.

STATEMENT OF THE INVENTION

This invention relates to roll edge protectors or covers and more particularly to roll edge protectors or covers for the edges of cylindrical bodies, such as coils of paper, coils of sheet metal, such as aluminum, copper, brass or other metals or coils of sheet plastic that have sharp end corners which are subjected to damage during handling and shipment. The roll edge protector or cover also has application as covering for the ends of large cylindrical shafts and similar cylindrical bodies that have been finish machined before shipment to protect them from niches, scratches and other damage. The roll edge protector or cover can also be used to protect the corners of rectangular bodies such as boxes, furniture and the like. The roll edge protector can be manufactured economically and there is no waste of materials since two protectors can be cut simultaneously from a single extrusion. The protector can be formed from a single extruded channel and the web of the channel is cut forming identical scallops on each channel. The roll edge protector itself is sufficiently flexible so that it can be coiled into compact packages for shipment and it is sufficiently thin that a coil of paper or metal so that the entire roll can be wrapped in sheet meterial like paper, for example, over the roll edge protector according to the invention protecting its ends so that it can be wrapped in paper, metal or other suitable wrapping material to protect the entire roll.

OBJECTS OF THE INVENTION

It is accordingly an object of the invention to provide an improved roll edge protector for protecting the corner edges of articles of manufacture during shipment or storage.

Another object of the invention is to provide an improved roll edge protector for cylindrical bodies of articles of manufacture.

Another object of the invention is to provide a roll edge protector that is simple in construction, economical to manufacture and simple and efficient to use.

Another object is to provide a roll edge protector extruded as a channel and cut into to angular protector elements.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DETAILED DESCRIPTION OF DRAWING

Figure 1:
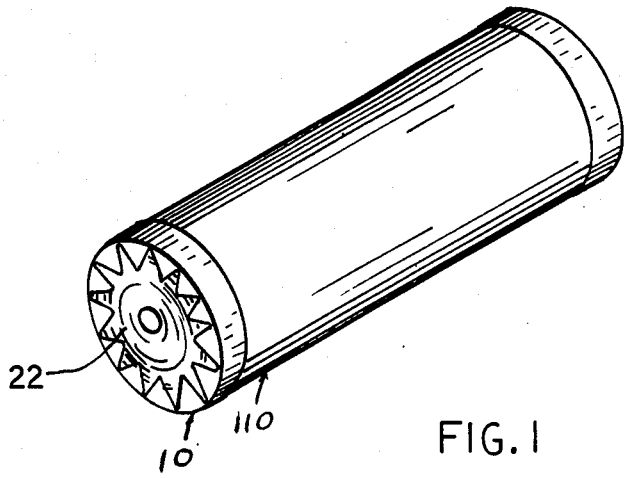
FIG. 1 is an isometric view of a roll edge protector in place on a roll according to the invention.
Figure 2:
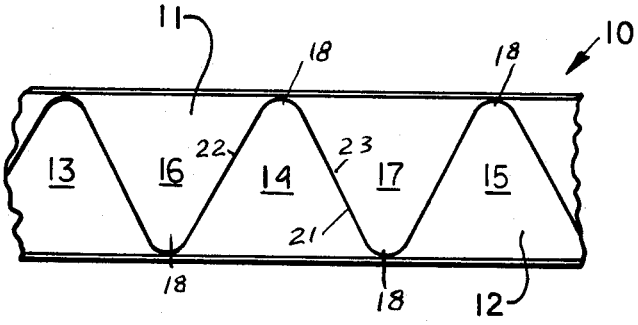
FIG. 2 is an enlarged side view of a piece of the protector according to the invention showing the lines along which the extruded channel is cut forming two separate roll edge protectors from a single channel shaped extrusion.
Figure 3:
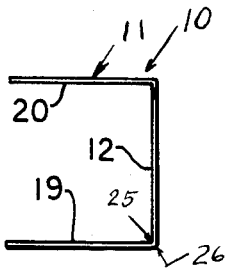
FIG. 3 is an end view of FIG. 2.
Figure 4:
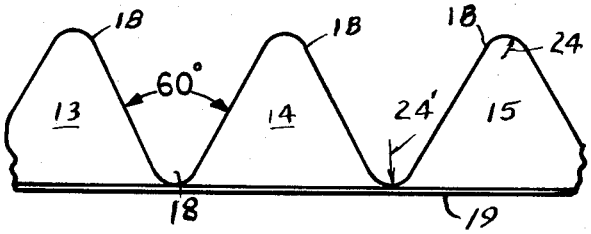
FIG. 4 is an enlarge view of a piece of the protector according to the invention.
Figure 5:
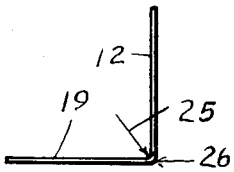
FIG. 5 is an end view of FIG. 4.

Now with more particular reference to the drawings, FIG. 1 shows a roll edge protector 10 in place on a roll of material 110. The protector 10 can be made of a strip of extruded flexible plastic material which is extruded in the form of a continuous channel 11. The channel 11 has a first leg 19, a second leg 20 and a web 12. Legs 19 and 20 are of equal length so that they can be conveniently formed and the channel can be cut forming two identical strips. Each leg is made two inches long. The web 12 may also be two inches wide.

The protector 10 is formed from the channel shaped extrusion 11 by cutting it along a wavy line 21 defining the scallops 13 through 15 and 16 and 17. Each scallop 13 through 15 and 16 and 17 has relatively straight sides 22 and 23 disposed at an angle preferably about 60 degrees to the flanges. The 60 degree angle allows virtually any diameter roll to be protected. The straight sides of each scallop 13 through 15 and 16 and 17 terminate in an arcuate point 18 which also define an arcuate root of complimentary shape. The radius of curvature 24 of the arcuate points 18, are equal to the radius of curvature of the roots. These radiuses of curvature 24 and 24' of the points 18 may be, for example, equal to a quarter of an inch or other suitable magnitude. The outside radius of curvature 26 is, for example, one thirty second of an inch. The radius of curvature 24' prevents a stress concentration and therefore makes the entire roll edge protector 10 more flexible, durable and less subjected to damage during handling. Radius 25 is greater than radius 26, making the intersection of leg 19 and web 12 and the intersection of leg 20 and web 12 the strongest points of the protector, offering the highest degree of protection of the roll being protected. The points 18 of each section of channel 11 of the protector 10 is cut close to the web 12 of the channel 11.

The roll edge protector 10 may be made of a thermoplastic material such as polyethylene, vinyl, styrene or any other suitable material. It could, in certain applications, be made of metal or even of heavy paper cardboard.

The material from which the roll edge protector 10 is made can be extruded in any desired length determined by the convenience of handling and economy and convenience of molding. It could be cut to predetermined lengths to conform to the circumference of the end of the rolls to which it is to be applied, depending on the capacity of the extrusion machine, handling and packaging and the size of the article to be covered. These scallops 13 through 15 and 16 and 17 could be made of a different size and shape than those set forth herein. The material can be extruded to a thickness of, for example, 0.030 inches, or any other suitable thickness.

The scallops 13 through 15 and 16 and 17 are preferably formed identical, but they could be varied in size and shape, depending on the application involved. The extruded material may be cut to any length, depending on the taste of the designer.

In practice, the method of manufacture is carried out by extruding a continuous length of thermoplastic material in the form of a channel 11, having legs of equal length and a web of width equal to the length of scallops desired form the first legs 19 and second legs 20. The web 12 of the channel 11 can then be cut along a continuous line 21 from one end of the web 12 to the other, the line 21 being curved to form a continuous array of scallops 13 through 15 on one leg and 16 and 17 on the other leg of the channel, providing two strips of roll edge protectors that are angular in cross section and may be wrapped around the ends of a cylindrical member 110 having edges to be protected. The radiuses 24 are provided on the outer corner and the inner corner of the channel 11 for strength and simplicity.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A method of making a roll edge protector for rolls of sheet material comprising:

forming thermo plastic material into continuous lengths in the form of a channel having a first leg and a second leg and a web connecting said legs, cutting said web along a continuous zig zag line from one end of said web to the other end, thereby forming a first continuous row of first scallops attached to said first leg and a continuous row of second scallops attached to said second leg, said scallops having straight sides disposed at an acute angle to one another, said scallops having arcuate tips and arcuate roots curved about equal radiuses of curvature.

2. The method recited in claim 1 wherein said channels are provided in pieces of approximately equal lengths approximately equal to the circumference of said rolls and fastening said roll edge protector in place on said rolls, wrapping each said piece around the ends of each said roll with said leg parallel to the axis of said roll.

3. The method recited in claim 2 wherein said thermoplastic material is formed by extruding.

4. The method recited in claim 1 wherein said thermoplastic material is taken from a group of polyethylene, vinyl and polystyrene.

5. The method recited in claim 1 wherein said first leg and said second leg are of substantially equal length.

* * * * *